US005641291A

United States Patent [19]

Sueki et al.

[11] Patent Number: 5,641,291

[45] Date of Patent: Jun. 24, 1997

[54] PRINTED CIRCUIT BOARD CONNECTOR

[75] Inventors: Kunimichi Sueki, Suita; Satoru Kihira, Osaka; Yasuyuki Takeda, Suita, all of Japan

[73] Assignees: Japan Solderless Terminal Mfg. Co., Ltd.; Polyplastics Co., Ltd., both of Osaka, Japan

[21] Appl. No.: 352,612

[22] Filed: Dec. 9, 1994

[30] Foreign Application Priority Data

Dec. 13, 1993 [JP] Japan ..... 5-342366

[51] Int. Cl.[6] ..... H01R 9/09

[52] U.S. Cl. ..... 439/83; 439/74; 439/931

[58] Field of Search ..... 439/83, 876, 931

[56] References Cited

U.S. PATENT DOCUMENTS

| | | | |
|---|---|---|---|
| 4,655,517 | 4/1987 | Bryce | 439/83 |
| 4,946,408 | 8/1990 | Garrett et al. | 439/876 |
| 5,030,113 | 7/1991 | Wilson | 439/931 |
| 5,147,209 | 9/1992 | Litwin et al. | 439/931 |

FOREIGN PATENT DOCUMENTS

| | | |
|---|---|---|
| 63-248081 | 10/1988 | Japan . |
| 1-96670 | 6/1989 | Japan . |
| 1-145071 | 10/1989 | Japan . |

*Primary Examiner*—Neil Abrams
*Assistant Examiner*—Eugene G. Byrd
*Attorney, Agent, or Firm*—Antonelli, Terry, Stout & Kraus, LLP

[57] ABSTRACT

A printed circuit board connector has: an insulating housing (2); SMT type contacts (7, 11) disposed in the insulating housing and spaced apart from each other; and each contact having a lead (11) which extends to a junction surface (2*a*) of the housing so as to be soldered to a conductive pattern (16) formed on a printed circuit board (15). The lead (11) of each contact is a plating layer (10) formed on the junction surface (2*a*). The contacts (7) are pin contacts held in place by the insulating housing (2) so as to be electrically connected to the plating layer (10) formed as the leads. The contacts' leads are included in a common plane so that the reliability of electric connection and the durability of connector are improved, and the connector is rendered thinner and more compact to reduce an area required to mount it.

1 Claim, 5 Drawing Sheets

PRINTED CIRCUIT BOARD CONNECTOR

BACKGROUND OF THE INVENTION

1. Field of the Invention

The present invention relates to a printed circuit board connector which is designed thinner and requires a smaller area when surface-mounted on a printed circuit board.

2. Description of the Prior Art

Each connector of this type generally comprises a plurality of contacts embedded in an insulating housing and each having a lead protruding therefrom. When such a connector is surface-mounted on the circuit board, the leads are aligned with a conductive printed pattern of the circuit board before soldered thereto by the re-flow technique. Therefore, all the leads have to be arranged such that their solderable portions are included in a common plane, to assure a coplanarity.

In manufacture of the contacts, a raw material is subjected to the pressing, bending, cutting and the like steps. Those steps have been causing more or less a residual stress in the leads of said contacts, giving rise to a fluttering and/or battering of the leads and thus failing to afford the coplanarity. Such an unevenness among the manufactured leads has been resulting in an imperfect soldering and/or short circuit problem that impair the reliability of electrical connection and durability of the connectors. This problem is serious especially in the surface-mountable connectors each having a number of the leads of high density and arranged at fine regular intervals.

Another problem inherent in the prior art connectors is that the leads protrude sideways to the right and left a considerable distance, thereby requiring a large area to mount each connector.

SUMMARY OF THE INVENTION

An object of the present invention made in view of such drawbacks is therefore to provide a printed circuit board connector having a plurality of contacts and of a novel type that the coplanarity of the contacts' leads is ensured to improve the reliability of electric connection and the durability of connector. Another object is to render the connector thinner and more compacted to reduce an area and space required to mount it.

According to the present invention, the printed circuit board connector comprises an insulating housing, a plurality of SMT type contacts disposed in the insulating housing, spaced apart from each other and respectively having leads which extend to a junction surface of the housing so as to be soldered to a conductive pattern formed on a printed circuit board, wherein at least the lead of each contact is a plating layer formed on the junction surface of the insulating housing.

In addition to the lead, each contact has a connectable portion so that the printed circuit board connector can be coupled with another connector or another circuit board. The connectable portion may be a discrete portion separated from but electrically adjoined to the corresponding lead, or alternatively be a further plating layer integral with that which is formed as the corresponding lead. A guide groove may preferably be provided in and along a bottom surface of each plating layer as the lead so that a molten solder can be guided towards the connectable portion.

In a preferable mode of the invention, the connectable portions are pin contacts which are secured to and protruding from the insulating housing. The plating layers formed on the housing to provide the leads are electrically adjoined to the pin contacts so that a pin header is constructed as a whole as the preferable type of the printed circuit board connector. A socket connector engageable with the pin header may comprise a plurality of connectable portions and a plurality of leads. Each lead extends from and longitudinally of the corresponding one of said connectable portions which are flat and bifurcate conductive pieces extending perpendicular to the axes of the pin contacts. An insulating housing which holds the socket contacts spaced apart from each other may have minute apertures in which the pin contacts are insertable front to back, or vice versa. Such a socket connector is advantageous in that two printed circuit boards can be overlaid parallelly one on another for mutual electric connection.

In use of the connector provided herein, the leads formed as the plating layers sticking to the junction surface of the insulating housing will be soldered to a conductive pattern on a printed circuit board so as to be surface-mounted thereon. The excellent coplanarity of those leads enables this connector to be completely and perfectly soldered to the conductive pattern. During the soldering, a molten solder will flow towards the connectable portion of each contact through the guide groove formed in the bottom of the contact's lead, thereby ensuring a reliable electric connection between the. contacts and the printed pattern.

THE PREFERRED EMBODIMENTS

Figure 1:
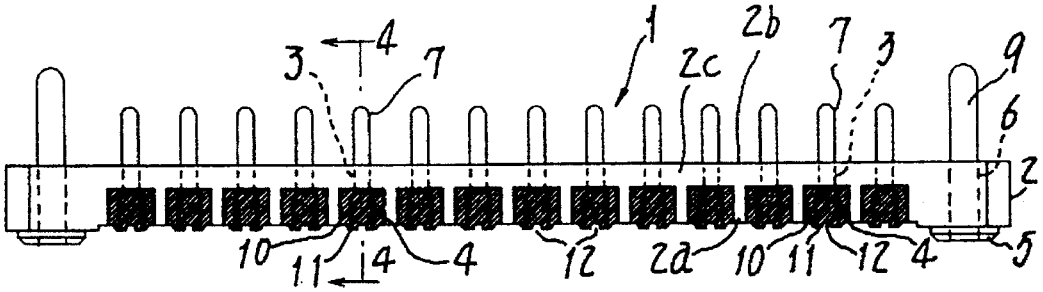
FIG. 1 is a front elevation of a pin header to which the present invention is applied in an embodiment.
Figure 2:
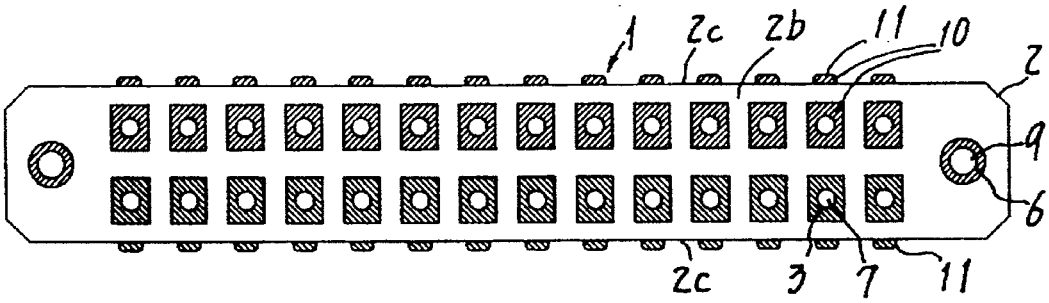
FIG. 2 is a plane view of the pin header.
Figure 3:
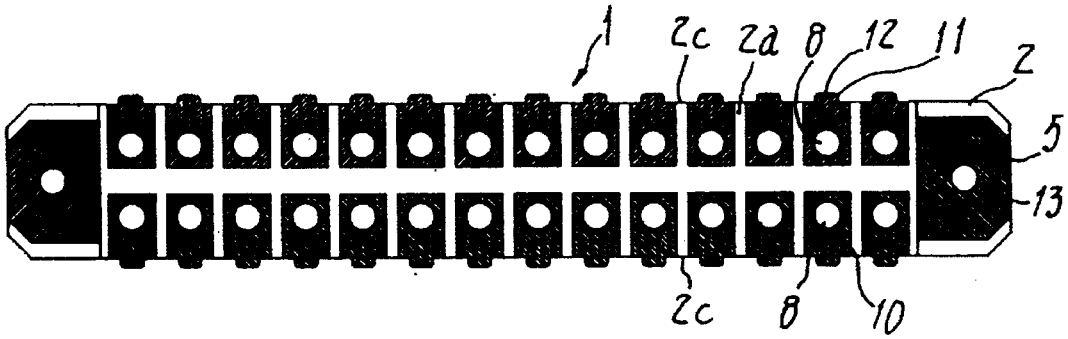
FIG. 3 is a bottom view of the pin header.

Now, some embodiments of the present invention will be described referring to the drawings.

FIGS. 1 to 4 illustrate a pin header 1 provided in an embodiment of the present invention, wherein the pin header is designed and constructed to be surface-mounted on a printed circuit board. An insulating housing 2 of the pin header 1 is made of a proper insulating plastics such as a liquid crystal polymer. A plurality of pin holes 3 formed in two rows and at a given pitch through the insulating housing are adapted to receive and hold pin contacts 7. Each pin hole 3 penetrates the housing 2, thus extending from its junction surface (viz. bottom surface) 2*a* to its top surface 2*b*. Ears 4 protrude sideways to the right and left from the housing's side surfaces 2*c*, at locations thereof corresponding to the pin holes 3. Positioning bosses 5 located adjacent to the junction surface 2*a* and at opposite ends of the housing 2 do bulge from the bottom thereof and beyond the junction surface. Additional holes 6 are formed through the opposite ends and the bosses so as to receive guide pins 9.

The insulating housing 2 of the described shape will be subjected to a plating process before the pin contacts 7 and the guide pins 9 are tightly inserted in the holes, as shown with hatches in FIGS. 1–4. In this process, discrete regions around the pin holes 3 are primed at first with copper and nickel and subsequently plated with gold. Plating layers 10 formed on the junction surface 2*a* by the electrogilding extend around the holes 3 and onto the corresponding ears 4. The plating layers also coat the inner peripheries of said holes so as to reach their mouths located at the top surface 2*b* of the insulating housing. Further, the junction surface region covering each boss 5 is also preferably be gilded to form a similar plating layer 10. This additional plating will serve to reinforce this region when surface-mounted on the circuit board, as will be described below.

The plating layers 10 of the insulating housing 2, particularly those which cover the junction surface 2*a* in part and around the pin holes 3 and cover the ears 4, do function as a plurality of leads 11. In use of this connector, those leads 11 will be soldered to a conductive pattern on the printed circuit board, in a manner described below. The ears 4 jutting from the side surfaces 2*c* of the housing 2 give the leads 11 a sufficient size and strength. In use, those ears may also be used to place the leads at correct positions relative to the circuit board to which this connector is automatically surface-mounted. As will be seen in FIGS. 1 and 3, a guide groove 12 formed in the bottom of each lead 11 extends from an outer extremity of ear 4 to the pin hole 3. When this connector is soldered to the circuit board, a molten solder will be guided along the grooves 12 towards the pin holes. The plating layers 10 covering the bosses 5 serve as reinforcing layers 13, when the bosses are soldered to positioning zones formed on the printed circuit board so that the insulating housing 2 is fixedly attached thereto.

The partial plating of the insulating housing 2 may be carried out by any proper one of the known methods of plating plastics materials, such as those disclosed in the Japanese Unexamined Patent Publications 57-108138 and 63-128181.

Figure 4:
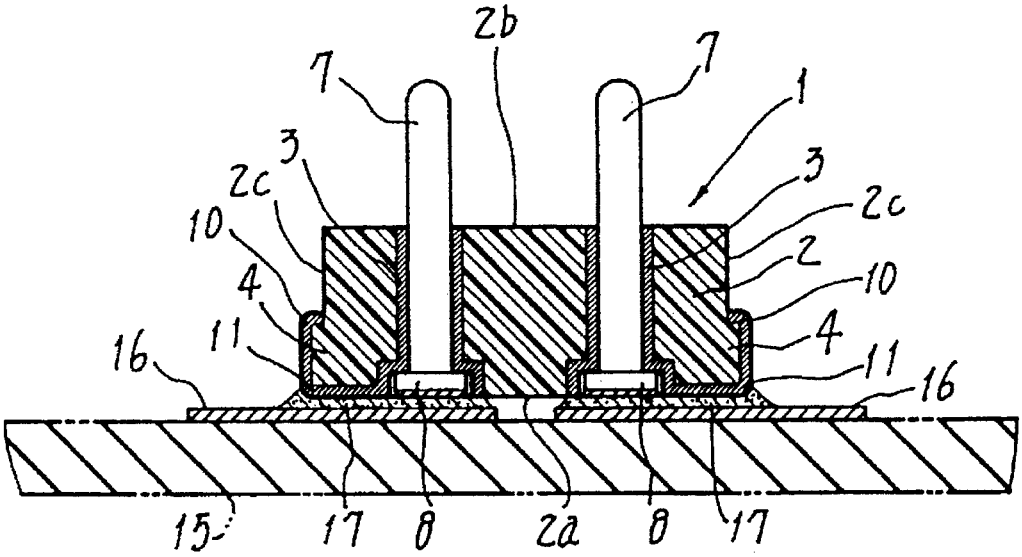
FIG. 4 is an enlarged cross section taken along the line 4—4 in FIG. 1.

The pin contacts 7 each having at their basal ends a flange 8 are made of a proper conductive metal such as a copper alloy. As shown in FIG. 4, each pin contact 7 is inserted in the pin hole 3, from its opening flush with the junction surface 2*a*, and protrudes from the top surface 2*b* of the insulating housing 2. The pin holes 3 will tightly hold the pin contacts 7 to complete the pin connector 1, wherein the flanges 8 are in an electrical contact with the respective leads 11 provided as the portions of plating layers 10.

In use of the pin header 1 of the described structure, it will be placed on a predetermined position of the printed circuit board 15 shown by the phantom lines in FIG. 4. The leads 11 as well as the flanges 8 of pin contacts 7 will then be soldered at 17 to the conductive pattern 16 formed on the circuit board, so as to realize electric connection and solid fixing of said contacts to said pattern.

Figure 5:
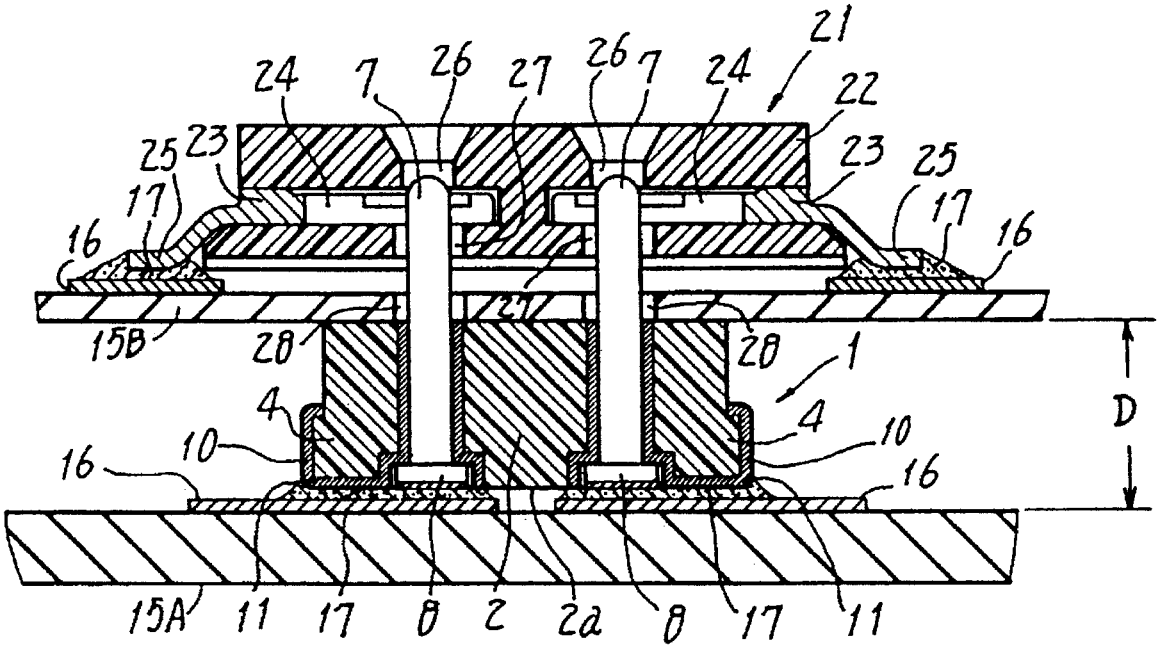
FIG. 5 is a vertical cross section of a board-to-board connection in which the pin header is connected to a socket connector designed cooperative therewith.
Figure 6:
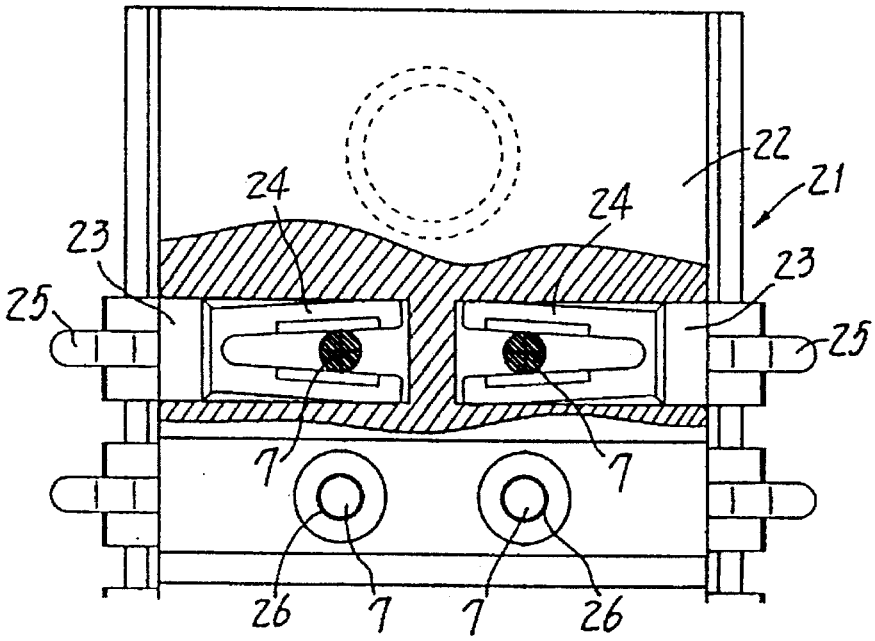
FIG. 6 is a plane view of the socket connector, shown with a part thereof being cut off.

FIGS. 5 and 6 illustrate an example of board-to-board connection in which the described pin header 1 is adjoined to a socket connector 21. This socket connector cooperates with the pin header to bring one of two printed circuit boards 15A into contact with the other 15B arranged in parallel therewith. The socket connector 21 also comprises an insulating housing 22 in which a plurality of socket contacts 23 are embedded spaced apart one from another, corresponding to the pin contacts 7. A thin sheet of a conductive metal such as beryllium-copper alloy or phosphor bronze is punched and bent to provide the socket contacts. Each socket contact 23 engageable with the pin contact 7 has a connectable portion 24 and a lead 25. This lead 25 extends from and longitudinally of the connectable portion 24, which is a flat and bifurcate conductive piece extending perpendicular to the axis of pin contact 7. The bifurcate connectable portion 24 grips the corresponding pin contact 7 to come into an electric contact therewith (see FIG. 6). The insulating housing 22 is a flat and rectangular parallelepiped through which front holes 26 and rear holes 27 are formed. Each front hole 26 extends coaxially with the corresponding rear hole 27, so that the pin contact 7 can be inserted into the insulating housing, from a front surface or alternatively from a rear surface thereof.

As noted above, the pin header 1 is surface-mounted on the printed circuit board 15A by soldering at 17 the leads 11 as the plating layers 10 to the conductive pattern 16. Further, the socket connector 21 will like-wise be surface-mounted on the other circuit board 15B also by soldering at 17 the leads 25 to the other conductive pattern 16. Apertures 28 formed through the other printed circuit board 15B are in alignment with the holes 27 formed through the socket connector 21. Subsequently, the two printed circuit boards 15A and 15B will be placed one on another and in parallel with each other, such that the pin contacts 7 of the pin header 1 penetrate the apertures 28 and the holes 27 through the socket connector 21. As a result, the respective pin contacts 7 fit in and engage with the bifurcate connectable portions 24 of said socket connector. In this state, the printed circuit boards 15A and 15B are electrically connected to, but separated a distance 'D' from, each other. This distance is equal to the height of the pin header 1, so that the thinner the pin header, the smaller is a gap left between the circuit boards.

Figure 7:
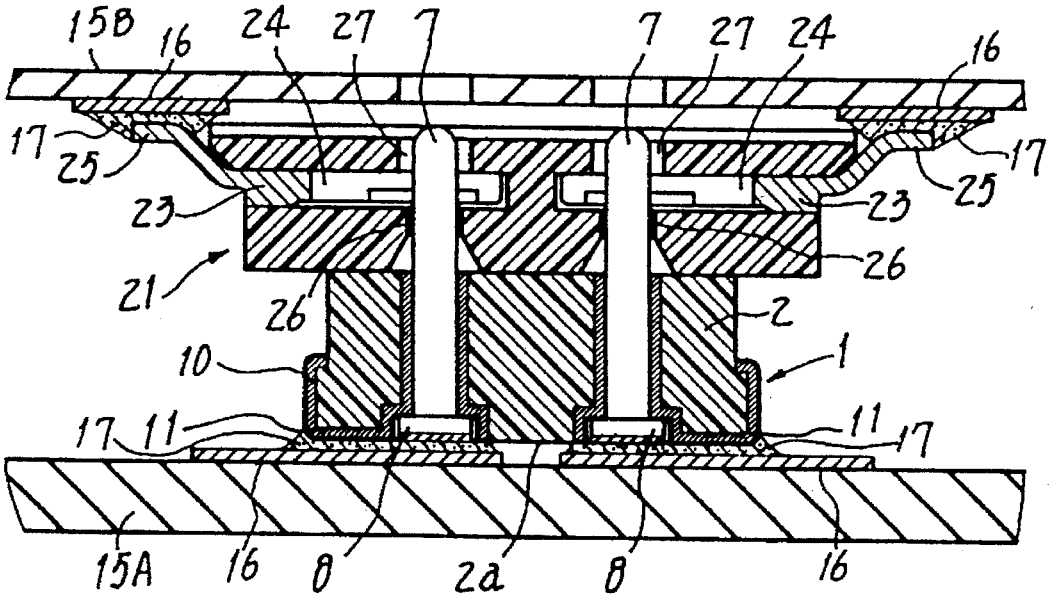
FIG. 7 is a vertical cross section of another board-to-board connection in which the pin header is connected to the socket connector in a different manner.

In another mode of use shown in FIG. 7, the pin header 1 directly faces the socket connector 21 so as to similarly bring the printed circuit board 15A into electrical connection with the other 15B. In this case, the pin contacts 7 are inserted in the other holes 26 also to electrically engage with the bifurcate connectable portions 24 of the socket contacts 23.

Figure 8:
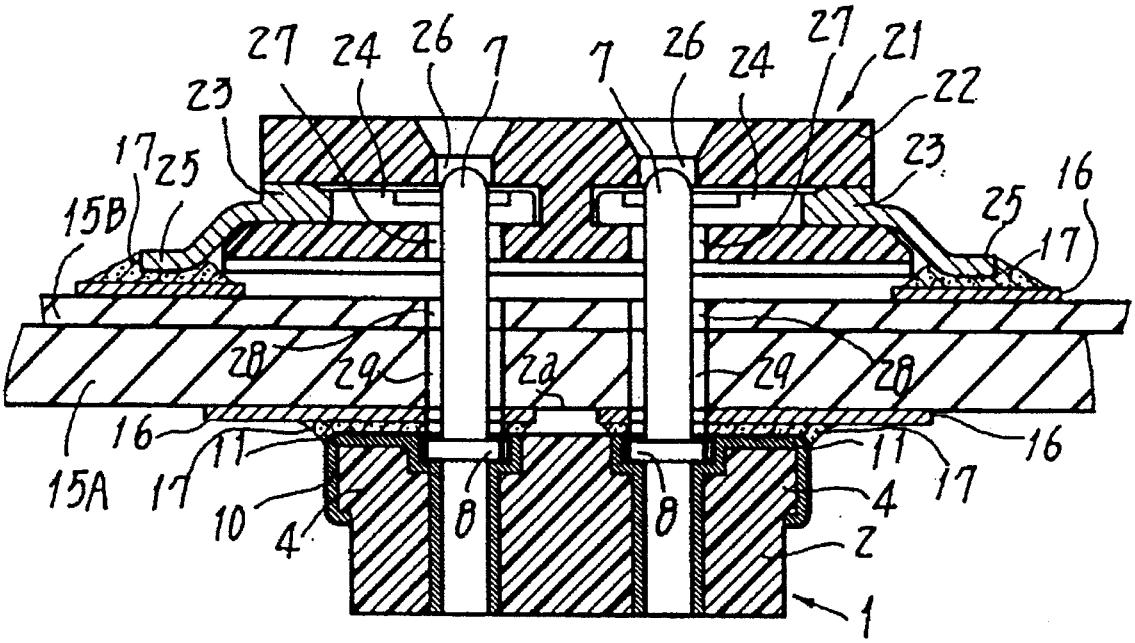
FIG. 8 is similarly a vertical cross section of still another board-to-board connection in which the pin header is connected to the socket connector in a further different manner.

FIG. 8 illustrates still another mode of use, wherein the two printed circuit boards 15A and 15B are in direct contact with each other in a back-to-back relationship. In this case, the pin contacts 7 protruding reversely beyond the junction surface 2*a* of the insulating housing 2 are inserted in further apertures 29 of the circuit board 15A and then inserted in the aforementioned apertures 28 of the other circuit board 15B, to likewise engage with bifurcate connectable portions 24 of the socket contacts 23.

Figure 9:
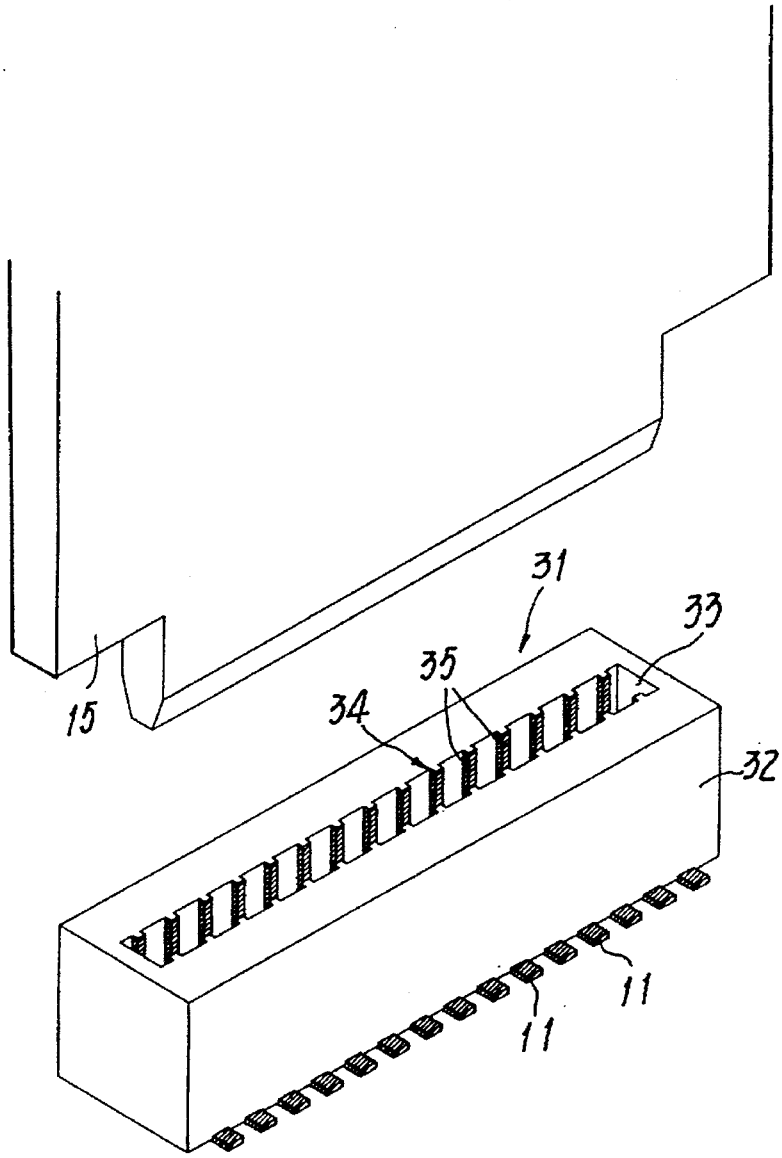
FIG. 9 is a perspective view of a card edge connector to which the present invention is applied in another embodiment.
Figure 10:
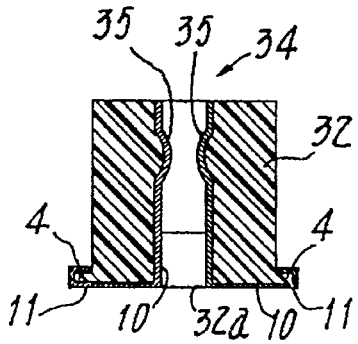
FIG. 10 is a cross section of the card edge connector.

Shown in FIG. 9 is a card edge connector 31 to which the present invention is applied. This connector is adapted to directly receive a protruding edge of printed circuit board 15. A plurality of female contacts 34 are arranged in an opening 33 formed in an insulating housing 32. Each female contact 34 will grip and come into electrical contact with a corresponding conductive terminal located at the circuit board's edge. As shown in FIG. 10, each lead 11 formed at the junction surface 32*a* of insulating housing 32 is an integral portion of a plating layer 10. Another integral portion thereof is a connectable portion 35 of the corresponding female contact 34. Similarly to the embodiment described above, ears 4 protrude sideways from the housing side regions to be coated with the plating layer 10 so that the leads 11 are formed.

It will be understood that the present invention is not restricted to the embodiments described above referring to the drawings, but may be modified in any desired manners.

In summary, the connector provided herein comprises the contacts each having a lead formed as a plating layer partially covering the junction surface of an insulating housing. A plurality of such leads are included in a common plane so that they can surely be soldered to a conductive pattern present on a printed circuit board, thus affording a reliability and durability to electrical connections. Any voluminous leads extending from the conventional contacts have no longer to protrude the insulating housing, so that a space for surface-mounting of connectors is now reduced to a noticeable extent.

Further, in a case wherein the connector provided herein is a pin header, not only this pin header but also a socket connector engageable therewith as defined in claim 1 will be rendered thinner such that two parallel printed circuit boards are adjoined one to another with a diminished gap intervening therebetween.

What is claimed is:

1. A printed circuit board connector comprising:

an insulating housing having a bottom junction surface and a top surface;

a plurality of pin holes formed at a given pitch and through the insulating housing so as to extend from the junction surface to the top surface;

plating layers each covering an inner periphery of a pin hole in a region of the junction surface, with the region continuing to the inner periphery, so that a portion of the plating layer coating the region provides a lead capable of being soldered to a conductive pattern formed on a printed circuit board;

ears each integral with and protruding sideways from a side surface of the insulating housing, each ear being located to correspond to a pin hole and coated with the plating layer;

guide grooves each formed in a bottom of the lead to extend from an outer extremity of the ear to the pin hole, so that when said connector is soldered to a circuit board, the guide grooves guide a molten solder along the grooves towards the pin hole; and pin contacts, each having at a basal end a flange and inserted into the pin hole from the junction surface of the insulating housing so as to jut upward from the top surface, such that each pin contact is firmly held in the pin hole, wherein the flanges are kept in electrical contact with the respective leads to thereby form a pin header of the surface-mountable type; said printed circuit board connector further comprising a socket connector engageable with the pin header, the socket connector comprising:

a plurality of socket contacts embedded in another insulating housing, the socket contacts being spaced apart from one another and arranged to correspond to the pin contacts;

each socket contact having a connectable portion and a lead extending therefrom, the connectable portion being a flat and bifurcated conductive piece extending perpendicular to an axis of a pin contact; and minute apertures formed through the other insulating housing such that the pin contacts are insertable in the socket connector front to back, or vice versa.

* * * * *